United States Patent [19]

Schliep

[11] Patent Number: 4,503,800

[45] Date of Patent: Mar. 12, 1985

[54] HEAT RESPONSIVE ALARM DEVICE

[76] Inventor: Carter L. Schliep, P.O. Box 485, Laytonville, Calif. 95454

[21] Appl. No.: 458,945

[22] Filed: Jan. 18, 1983

[51] Int. Cl.[3] ..... G08B 17/00

[52] U.S. Cl. ..... 116/221; 116/101; 116/152

[58] Field of Search ..... 116/221, 102, 101, 192, 116/DIG. 22; 374/205, 206

[56] References Cited

U.S. PATENT DOCUMENTS

| | | | |
|---|---|---|---|
| 1,442,509 | 1/1923 | Aeschbach et al. | 116/102 |
| 1,823,722 | 9/1931 | Birtciel | 116/101 |
| 3,015,955 | 1/1962 | Argabrite | 374/206 |
| 3,628,494 | 12/1971 | Bilotta | 116/102 |

*Primary Examiner*—Charles Frankfort
*Assistant Examiner*—David R. Schuster
*Attorney, Agent, or Firm*—James E. Toomey; Ralph L. Freeland

[57] ABSTRACT

A metallic bell-type alarm device for indicating the need for refueling or otherwise adjusting the heat generated within a wood stove or the like. The device is mounted on or adjacent to a stove at a location where it can respond to heat fluctuations in the stove. It comprises a metallic casing and base plate having mounted therein a bimetallic spring having a free-riding clapper washer mounted thereon and a trigger rod that cooperate to sound a bell alarm when significant temperature changes cause the spring to react to change position and strike the metal casing to sound a bell alarm.

5 Claims, 6 Drawing Figures

HEAT RESPONSIVE ALARM DEVICE

BACKGROUND OF THE INVENTION

This invention relates to a heat responsive thermally actuated bell type alarm device or the like for signalling the need for refueling or adjusting the heat produced within a stove or other combustion device and particularly wood-burning stoves.

Prior Art

It is well known to utilize alarm devices and systems having bells to signal a change in temperature within a stove, incubator, oven, or the like. Such arrangements are shown in U.S. Pat. Nos. 586,329 to Bright, 1,001,719 to Westfall and 1,037,084 to Trapp. However, none of these devices disclose or suggest the use of a bimetallic spring to provide the alarm or direct ringing or sounding of the bell. Westfall and Trapp disclose incubator alarms wherein thermostats within the incubator housing are operatively connected to dampers on the heaters outside of the housing, the dampers being connected through linkage arrangements to a bell housing whereby movement of the dampers actuate the bells. Bright utilizes thermally sensitive members of a different metal than the rest of the assembly. U.S. Pat. No. 4,236,668 to Prikkel is of interest in that it shows the mounting of thermally responsive coils in a flue duct, but not as part of an alarm device.

SUMMARY OF THE PRESENT INVENTION

Thermally responsive alarm devices are well known. They have been used for many years. However, most of them that are reliable comprise complicated and expensive equipment. Frequently, they are difficult to assemble as well as expensive to maintain. The present invention has the advantage of being a simple compact design that is readily assembled and foolproof in its operation.

Essentially, the invention is a heat responsive bell alarm device which comprises an outer metallic casing, a base plate therefor, a thermally responsive bimetallic spring mounted in the casing and adapted to be moved by expansion and contraction due to temperature fluctuations, trigger means in the wall of the casing for restraining movement of the spring until the pressure thereof due to the temperature of the system that is being monitored reaches a preselected point, at which time the spring snaps over and past the trigger rod and impinges against the wall of the casing to sound a bell alarm. A more complete understanding of the invention can be had be reference to the accompanying drawings.

DESCRIPTION OF THE PREFFERED EMBODIMENT OF THE INVENTION

Figures 1, 2, 3, 4, 5, 6:
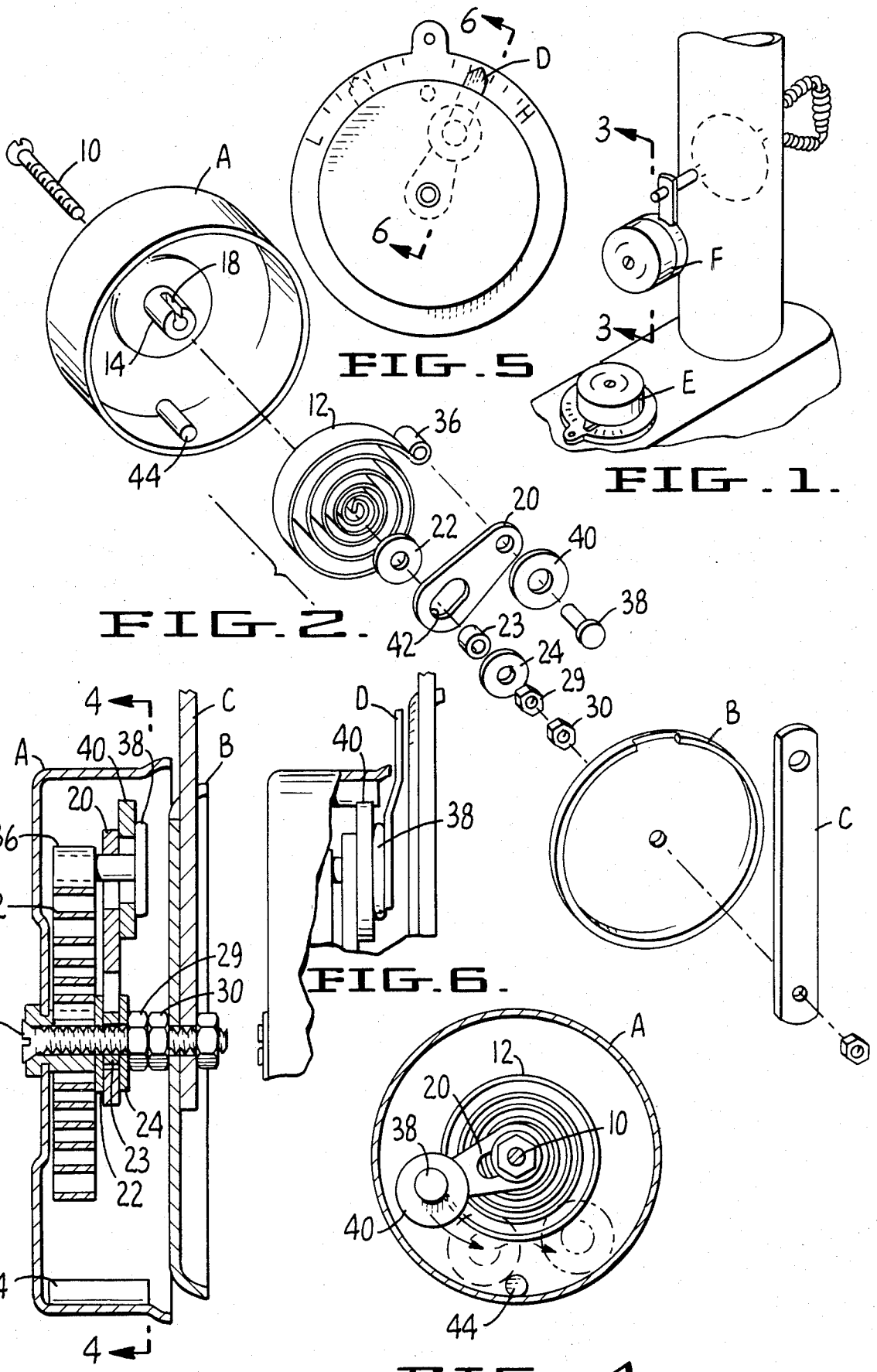
FIG. 1 is a perspective view, partly in outline showing the device of the invention when in use on a broken away portion of a wood stove, and showing part of the flue which serves as the heat source with which the alarm device is integrated. It also depicts two alternate arrangements for mounting the disclosed forms of alarm device on such a stove.
FIG. 2 is an exploded perspective view of the alarm device of the invention showing its essential parts.
FIG. 3 is a view of the invention in vertical section taken along the lines 3—3 of FIG. 1 looking in the direction of the arrows.
FIG. 4 is a sectional view of the invention taken along lines 4—4 of FIG. 3 looking in the direction of the arrows.
FIG. 5 is a top plan view of the metal casing in a modified form showing the device when calibrated for preselected heat adjustments.
FIG. 6 is a broken away view partly in section of the alarm device of FIG. 5 having dial type indicators.

By reference to the drawings it will be noted that the alarm comprises metal casing A and base plate B. A metal screw 10 is seated in the top center of casing A where it is reinforced within by partially slotted shim 14. Bimetallic coil 12 is inserted in casing A and seated about shim 14 so that the end thereof which is the center of the coil spring is bent inwardly and inserted into slot 18 of shim 14. As will be further explained, the central location of slot 18 is of importance in the seating and placement of bimetallic spring 12.

Spring retainer 20 is next fitted onto screw post or bolt 10 on top of spring 12. It is advantageously sandwiched between washers 22 and 24, and shim 26 is also desirably used in certain embodiments wherein it is fitted into the elongated generally oblong open area of 28 of spring clip 20 between washers 22 and 24 and assures free movement of the clip with minimum wear on the parts in the operation of the device. The bimetallic spring 12 is then securely fastened by any desirable method. In the present embodiment a double nut arrangement 29 and 30 which engages screw post or bolt 10 extending through casing A serves as the fastening device.

Base plate B is then applied and fitted over that portion of bolt 10 which extends beyond base plate B and fastened to bolt 10 by nut 32. A hanger element C may also be used to hang or otherwise enable the assembled alarm device to be fixed in place for use. It may conveniently be fastened between base plate B and nut 32 onto screw 10 and is adapted to fit within slot 34 on the outer periphery of base plate B to resist rotation of the bell assembly.

In the assembly of the bimetallic coil spring element it is to be noted that coil 12 includes at its outer end, a looped portion 36 which is adapted to receive bolt or rivet 38 which fits through loosely fitting clapper washer 40 mounted on the opposite end of spring retainer clip 20 and passing through opening 42 thereof. Bolt or rivet 38 thus loosely engages clapper washer 40 and permits it to respond to any movement of coil spring 12 which is reflected by movement at the end of the spring 36. Integrated therewith is trigger rod 44 which is located to abut against and protrude from the inside wall of the casing A. Trigger rod 44 extends for approximately the depth of cylindrical metal casing A and terminates just short of casing B when assembled. The location of clapper washer 40 on bimetallic coil spring 12 is so adjusted with respect to rod 44 that washer 40 is restrained by rod 44 when in a contracted or expanded condition as will be more fully explained in the operation of the device. It is to be noted that the function of spring retainer clip 20 is to keep bimetallic spring 12 from exerting continuous pressure on clapper washer 40 and casing A. The spring retainer in effect provides an independent mounting for the clapper washer 40 and without clip 20 the bell does not ring but simply makes a dull thumping sound.

In the operation of the alarm system of this invention with the assembly of casing A and base plate B in heat responsive communication with the wall of a stove or the flue thereof as shown in FIG. 1, the bimetallic coil spring 12 expands. When the amount of heat to which the device is calibrated to respond is sufficient for the desired level of comfort and heat expected to be emitted by the stove or other combustion device the expanded spring 12 carries clapper washer 40 in a counterclockwise direction. Thus when washer 40 reaches trigger rod 44 further movement thereof is restricted until the pressure of expansion is so great that washer 40 snaps over and rolls past rod 44 to strike the wall of metal casing A and sound the bell alarm. This enables adjustment of stove air dampers to prevent possible overheating or wasting of fuel. Normally after ringing the first time the stove is at operating temperature.

While sufficient heat is thus thrown off by the stove the spring 12 remains in an expanded condition until the consumption of fuel and other factors may cause the stove to cool and the metallic spring to contract in a clockwise direction accordingly. When the device cools to a point approaching that at which fuel will be required, it reaches trigger rod 44 which resists further movement until the pressure of contraction is so great that the washer snaps over and rolls past the trigger rod 44 and clapper washer 40 strikes the wall of closure A sounding the bell alarm.

In the modification of the invention shown in FIGS. 5 and 6, the design of base plate B is modified so that it is of sufficiently greater radius to provide an area for calibrations to be embossed, printed or otherwise marked theron as shown in FIG. 5. A dial D extending radially from the center of the bell assembly and approximately along the center line of spring clip 20 is integrated to function with the calibrations of the enlarged base plate B and the movement of coil 12 as it responds to temperature changes in the stove as shown in the respective full line and dotted line positions of dial indicator D in FIG. 6. The dial is desirably calibrated to indicate whether the stove temperature is such that the bell has rung or is about to ring. The dial D is adapted to fit between the open space between casing A and base plate B. Although the described arrangement is not a thermometer it is useful to visually indicate whether the stove needs adjustment.

As previously stated, the alarm device can also be placed on the surface of a stove as shown in alternative embodiment E depicted in FIG. 1.

The foregoing represent preferred embodiments. Various changes may be made within the scope of the appended claims, including mounting the bimetallic spring on the base plate of the device.

I claim:

1. A heat responsive alarm device adapted to be in heat conductive communication with a stove device comprising, an exterior metal casing having a skirtlike sidewall member of sufficient depth to enclose the elements mounted thereon, a centrally disposed screw means mounted on said metal casing extending therethrough and terminating beyond the depth thereof, a base plate adapted to be connected to said metal casing by said screw means at a point thereon beyond the elements mounted in said metal casing, a heat responsive bimetallic coil spring fixedly mounted at its inner end on said screw means within said casing to thereby prevent movement of the inner end of said coil spring relative to said casing and the outer end of said coil spring extending toward said sidewall member of said metal casing, a rotatable clapper element mounted on said outer end of said bimetallic coil spring for direct engagement with said sidewall member, trigger rod means adjacent said casing adapted to restrain movement of said rotatable clapper element during expansion or contraction of said bimetallic coil spring until the pressure exerted thereon due to fluctuations in the temperature thereof in excess of or below a preselected value result in expansion or contraction of said spring cause said clapper element to move radially by expansion or contraction to snap past said trigger rod means and against said sidewall of said metallic casing to thereby sound a bell alarm.

2. The alarm device of claim 1 wherein the metallic bell casing is of a generally cylindrical shape.

3. The alarm device of claim 1 wherein the base plate is round in shape and extends radially beyond the metallic casing to provide an exposed face area sufficient for calibrations to be placed on said plate.

4. The alarm device of claim 1 wherein an indicator dial is connected to and integrated with said bimetallic coil spring to indicate the need for adjusting the heat emitted by the stove, the fuel therein and whether or not the bell alarm has rung.

5. A temperature alarm bell for sounding both presettable high temperature and low temperature conditions comprising a bell-shaped metal cover spaced apart from and mounted on a base plate by a central support rod, a clapper member formed by a temperature responsive bimetallic coil spring having one end anchored to said central support rod and the other end extending as a free hammer end to contact said bell-shaped cover, a cam member supported by said base for frictionally engaging said free hammer end of said clapper member upon expansion or contraction of said coil spring in response to temperatures above and below said presettable conditions whereby said expansion and contraction of said coil spring forces said free hammer end over said cam member so as to strike said bell-shaped cover to sound an alarm that said temperature conditions have been exceeded.

* * * * *